US006319101B1

(12) United States Patent
Vago

(10) Patent No.: US 6,319,101 B1
(45) Date of Patent: Nov. 20, 2001

(54) SHOT-BLASTING MACHINE FOR CLEANING A LINEAR METAL ELEMENT

(75) Inventor: Luigi Vago, Lovere (IT)

(73) Assignee: Pan Chemicals S.p.A., Lovere (IT)

( * ) Notice: Subject to any disclaimer, the term of this patent is extended or adjusted under 35 U.S.C. 154(b) by 0 days.

(21) Appl. No.: 09/341,648

(22) PCT Filed: Jan. 8, 1998

(86) PCT No.: PCT/EP98/00144

§ 371 Date: Sep. 10, 1999

§ 102(e) Date: Sep. 10, 1999

(87) PCT Pub. No.: WO98/31505

PCT Pub. Date: Jul. 23, 1998

(30) Foreign Application Priority Data

Jan. 15, 1997 (IT) ..... MI97A0055

(51) Int. Cl.[7] ..... B24C 5/06
(52) U.S. Cl. ..... 451/94; 451/96; 451/98
(58) Field of Search ..... 451/94, 96, 98, 451/83, 87

(56) References Cited

U.S. PATENT DOCUMENTS

| | | | |
|---|---|---|---|
| 2,874,451 | | 2/1959 | Ailes et al. . |
| 3,107,455 | | 10/1963 | Gloor et al. . |
| 3,383,803 | * | 5/1968 | Schulte et al. . |
| 3,481,080 | * | 12/1969 | Davidson . |
| 3,735,532 | * | 5/1973 | Long, III . |
| 4,175,412 | | 11/1979 | Bernot . |
| 4,254,593 | | 3/1981 | Paulfeuerborn . |

FOREIGN PATENT DOCUMENTS

| | | |
|---|---|---|
| 351 929 | 3/1961 | (CH) . |
| 827 643 | 1/1952 | (DE) . |
| 10 35 089 | 7/1958 | (DE) . |
| 18 15 187 | 10/1969 | (DE) . |
| 42 00 292 | 7/1992 | (DE) . |
| 2 374 141 | 7/1978 | (FR) . |
| 2 386 390 | 11/1978 | (FR) . |
| 889 174 | 12/1981 | (SU) . |

* cited by examiner

*Primary Examiner*—Timothy V. Eley
*Assistant Examiner*—Willie Berry, Jr.
(74) *Attorney, Agent, or Firm*—Nixon & Vanderhye, P.C.

(57) ABSTRACT

A shot-blasting machine for cleaning a linear metal element, such as a metal rod, a metal wire and the like. The shot-blasting machine is arranged in line with a drawing machine so that continuous process is provided. The shot-blasting machine is enclosed in a cabin provided with a suction system for sucking the dust, and with inlet and outlet prechambers, provided with labyrinths and curtains, that allow the passage of the rod and meanwhile prevent the outflow of shots.

15 Claims, 8 Drawing Sheets

SHOT-BLASTING MACHINE FOR CLEANING A LINEAR METAL ELEMENT

The present invention relates to a shot-blasting machine for cleaning a linear metal element, such as a metal rod, a metal wire and the like.

It is known that metal rods (bars) are obtained from metal billets via rolling at high temperatures. Afterwards, in order to form metal wires having a preselected diameter, the rods are submitted to drawing. Drawing consists in a reduction of the cross-section of the rod in a drawing machine performed by means of successive passages through dies provided with holes having decreasing dimension, called die plates or draw plates. In order to make easier the passage through the die plates, the surface of the rod is preferably coated with suitable lubricants.

It is also known that, during the rolling step and the subsequent cooling process, a layer of oxides is formed on the surface of the rods that prevents a good lubrication of the rod in the subsequent drawing step. Therefore, the surface of the rod has first to be cleaned in order to remove completely the layer of oxides before performing the drawing step.

Several methods are known for cleaning the rods. One of them is the shot-blasting method.

Shot-blasting is an acid-free method and has the advantage that it is applicable to a wide range of materials and products of different diameters.

Shot-blasting is a process wherein the external surface of a metal rod is exposed to vigorous jets of shots, preferably metallic, so as to obtain a clean surface.

Generally, shot-blasting is performed by passing longitudinally one rod having a diameter of from about 1 mm to about 40 mm, usually of from about 5 mm to about 18 mm, through a machine called shot-blasting machine. In the shot-blasting machine, metal shots are projected against the surface of the rod by means of rotors provided with radial vanes that are supplied axially from the center and that, owing to the centrifugal force, project the shots in a radial direction at a very high speed. Usually, a shot-blasting machine is provided with three rotors arranged at 120°, or with four rotors arranged at 90° one to the other, so that the surface of said rod is exposed to the jet of shots. The rotors are mounted with their axis of rotation orthogonal to the longitudinal axis of the rod, preferably staggered with respect to the direction of advancement of the rod.

The shots are continuously recycled to the rotor or the rotors, after they have been reconditioned.

Generally, the shot-blasting machine is arranged in line with a drawing machine so that a continuous process is provided. The shot-blasting machine is enclosed in a cabin provided with a suction system for sucking the dust, and with inlet and outlet prechambers, provided with labyrinths and curtains, that allow the passage of the rod and meanwhile prevent the outflow of shots.

These shot-blasting machines have several drawbacks.

The jet of shots leaving the rotor has, in a direction transversal to the direction of advancement of the rod, a width equal to the width of the vanes. Such width usually is of from about 40 mm to about 100 mm, while the diameter of the rod usually is of from about 5 mm to about 18 mm. In order to reduce the dispersion of the flow of shots in a direction transversal to the direction of advancement of the rod and to bring it to a dimension closer to that of the rod diameter, each rotor is generally provided with a pair of convergent plates (also known as concentrating plates) that convey the jet of shots projected by the rotor towards the rod. However, since the plates must be kept at some distance one from the other in order to ensure the immediate outflow of the shots, the width of the jet of shots is in any case substantially greater than the diameter of the rod to be hit. Therefore, a major portion of the shots projected by the rotor does not hit the rod and is ineffective for the cleaning process. In addition, the jet of shots undergoes a loss of kinetic energy due to the interference with said concentrating plates.

Owing to the low overall efficiency of the process, in order to obtain the desired level of cleaning it is necessary to use high powers motors and that increases the overall production costs. This results in high maintenance costs, high wear of the parts of the machine and high shots consumption.

Machines of this type are also used for cleaning the surface of metal wires.

FR-A-2 386 390 discloses a continuous, multiple passage shot-blasting machine comprising a chamber wherein there is mounted a rotor or another means capable of projecting shots against a wire. The wire to be shot-blasted passes through said chamber winding itself around two drums. Thus, inside the chamber there is formed a plurality of considerably close, crossed strands resulting in a layer having a width at least equal to that of the jet of shots. In this way, an upper surface and a lower surface of wire portions are alternately submitted to the jet of shots. In this machine, said wire portions move alternately along two planes inclined one respect to the other, i.e. crisscrossed planes.

The Applicant has found that this inclined arrangement has the drawback of hindering a good cleaning of the wire (Tables II and III, tests 04, 05 and 06).

CH-A-351 929 discloses a device for mechanical descaling an unfinished product, particularly a metal strip. In said device separate jet means are provided for each of two working steps. During each working step upper and lower surfaces of said unfinished product are hit by said jet means with the same angle of impact. Particularly, in FIG. 8 of said document, it is shown an embodiment of the device wherein two strip portions move alternately along two planes inclined one respect to the other. Thus, a part of the upper surface and a part of the lower surface of said strip portions are simultaneously hit by a jet of shots.

This arrangement shows the same drawback as mentioned in relation to FR-A-2 386 390.

It has now been found that these drawbacks can be overcome by means of a shot-blasting machine for cleaning a surface of a linear metal element comprising guiding means for said linear metal element and at least a rotor provided with vanes, said rotor being capable of projecting a jet of shots against said linear metal element, said guiding means being capable of directing said linear metal element in the field of action of said jet of shots at least a first and a second time, exposing in said field of action simultaneously at least a first and a second part, respectively, of said surface, characterized in that said at least a first and a second part of said surface are kept by said guiding means under said jet of shots substantially on a same plane, side by side and at a prefixed close distance (dv) at least for the whole path travelled by said linear metal element in said field of action of said jet of shots.

According to a preferred embodiment, said linear metal element has a prefixed diameter and said distance (dv) is equal or lower than about 3 times the diameter of said linear metal element. Preferably, said distance (dv) is of from about 0.1 to about 2 times the diameter of said linear metal element. More preferably, said distance (dv) is of from about 0.5 to about 1.5 times the diameter of said linear metal element.

According to another preferred embodiment, said guiding means are capable of directing a first portion of said linear metal element in a first direction of movement and a second portion of said linear metal element in a second direction of movement substantially opposite with respect to said jet of shots.

According to a further preferred embodiment, said first portion of said linear metal element turns said first part of said surface towards said jet of shots and said second portion of said linear metal element turns said second part of said surface towards said jet of shots.

Advantageously, said guiding means comprise a first snub pulley capable of directing said first portion of said linear metal element, coming from a direction of advancement, towards said first direction of movement and a second snub pulley capable of directing said second portion of said linear metal element, coming from said second direction of movement, towards said direction of advancement.

Moreover, said guiding means comprise at least a third and a fourth snub pulley capable of inverting the motion of said linear metal element from said first to said second direction of movement and simultaneously moving said second portion to one side of said first portion.

Further, said third and fourth snub pulley are inclined one respect to the other by a prefixed angle such as to bring back said second portion practically to the same level of said first portion while keeping the second portion side by side with the first portion.

Typically, said third and fourth snub pulley are inclined one respect to the other by a prefixed angle ($\alpha$) of from about 1° to about 6°. Preferably, said angle ($\alpha$) is of from about 2° to about 4°. According to a preferred embodiment, said third snub pulley supports said first portion of said linear metal element and directs it downward so that it winds itself around said fourth pulley by an angle greater than 180°, said fourth pulley bringing said second portion of said linear metal element back to the side of said first portion so that longitudinal axes of said first and second portion lie on said plane.

Preferably, said guiding means also comprise directing devices capable of adjusting the position at said distance (dv) and alignment of said first and second portion of said linear metal element upstream and downstream of said rotor.

Moreover, said directions of movement of the portions of linear metal element inside the machine are substantially orthogonal to said direction of advancement.

According to another embodiment, said shot-blasting machine comprises two rotors.

Said rotors are on the same side or on opposite sides with respect to said first and second portion of said linear metal element.

Advantageously, said rotor(s) rotate(s) around axis(es) perpendicular to said first and second portion of said linear metal element.

Preferably, said portions of the linear metal element have a distance from said at least one rotor of a value of from about 20 mm to about 200 mm. More preferably, said value is of from about 40 mm to about 100 mm.

The main advantages of the shot-blasting machine according to the invention consist in the fact that the target effectiveness of the jet of shots and the cleaning efficiency of the linear metal element are enhanced with respect to the known machines. This is due to the fact that under the jet of shots projected by the rotor there are simultaneously present two substantially parallel and close portions of linear metal element (rod or wire) at least for the whole path travelled by the linear metal element in the field of action of the jet of shots.

Moreover, the cleaning of the entire surface of the linear metal element can be carried out even with just one rotor. In fact, thanks to the double passage of the linear metal element under the jet of shots in one direction and in the opposite direction, one part of the surface of the linear element portion is cleaned first and subsequently the opposite part of the surface of said portion.

The machine comprising more than one rotor allows increasing the speed of advancement of the linear metal element and thus an enhancement of productivity over the machine having only one rotor. While, when the advancement speed of the linear metal element and operating conditions are the same as in a machine having only one rotor, it requires a lower power supply.

A reduction in the dimension of the machine is also obtained along the direction of advancement of the linear metal element because the machine is arranged transversally with respect to said direction. When the machine is provided with just one rotor a further reduction in size is also obtained.

Further advantages are obtained in that the shot-blasting machine according to the invention allows a reduction in the costs of treatment of the linear metal element as well as of maintenance.

Further features and advantages of the invention will now be illustrated with reference to embodiments represented as non-limiting examples in the enclosed drawings, wherein.

Figure 1:
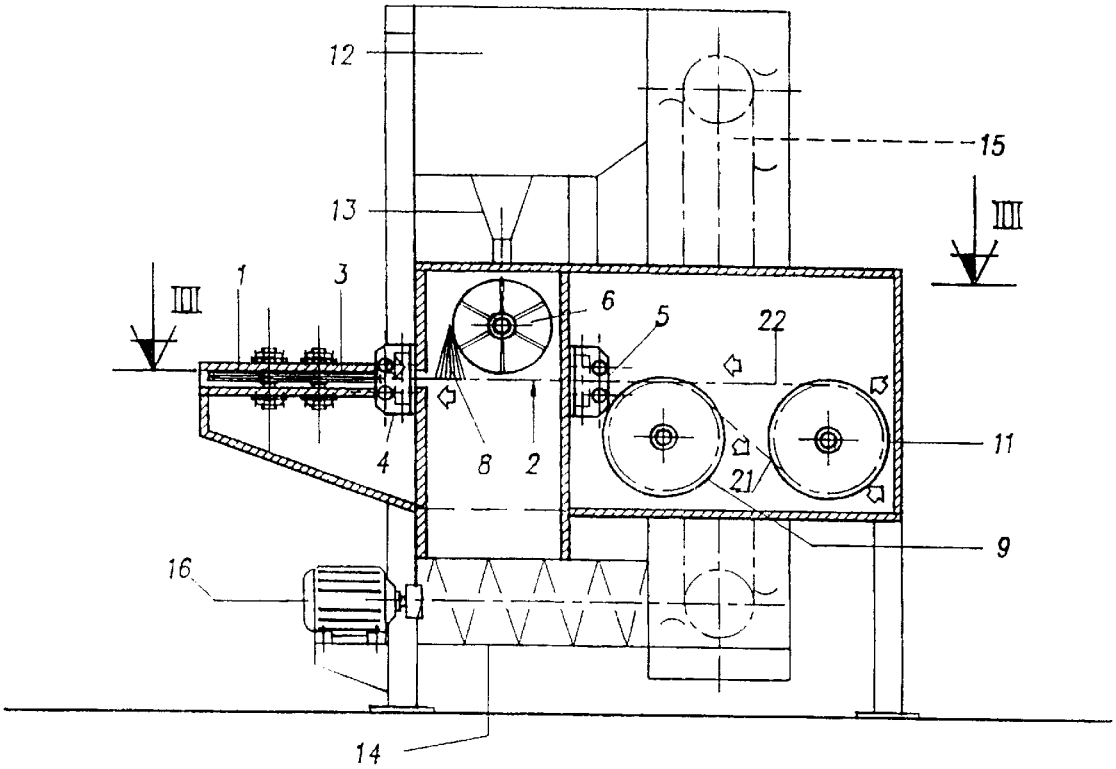
FIG. 1 is a partial, longitudinal cross-sectional view of a shot-blasting machine made according to the invention.

There is shown in FIGS. 1–5 a shot-blasting machine interposed between a decoiler and an external driving device (not shown) of a rod, or wire, 2. The driving means can, for example, be a drawing machine, a coiling machine or any other machine provided with a motor capable of driving said rod, or wire, 2 in a direction of advancement 18.

The shot-blasting machine comprises two idle snub pulleys 1 and 3. The snub pulley 1 is capable of directing a forward portion (branch) 21 of the rod 2, coming from the direction of advancement 18, towards a first direction of movement of a path internal to the machine. The snub pulley 3 is capable of directing a backward portion (branch) 22 of the rod 2, coming from a second direction of movement of the path internal to the machine, towards the direction of advancement 18.

The shot-blasting machine comprises a rotor 6, driven by an electric motor 7, capable of projecting a jet of metal shots 8 towards the two portions 21 and 22 of the rod.

The metal shots is supplied to the rotor 6 by a feeder 12 through a funnel 13 and an elbow pipe (not shown). The shots used for cleaning the rod 2 is collected by a screw worm conveyor 14 driven by an electric motor 16 and brought back to the feeder 12 by an elevator 15 driven by an electric motor 17. Instead of the screw worm conveyor 14, a hopper-type collector (not shown) can be used to convey the shots towards the elevator 15.

Figure 2:
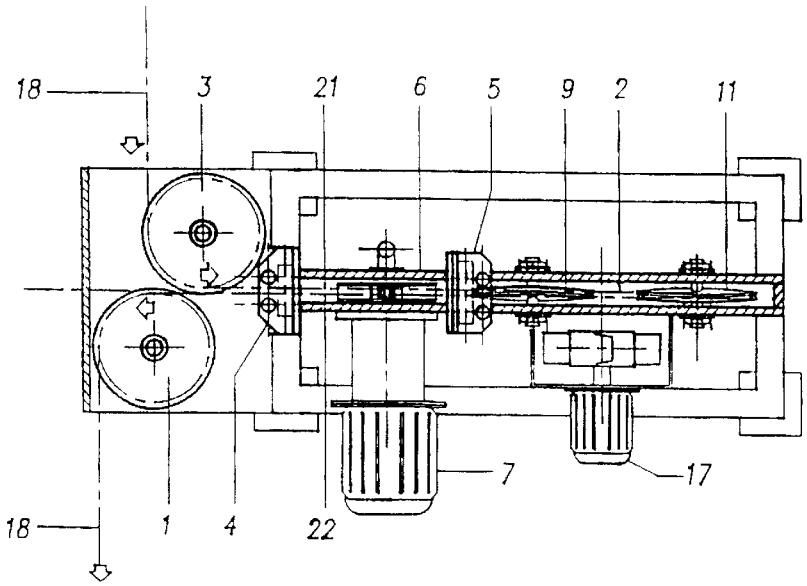
FIG. 2 is a partially sectioned view taken along the line II—II of FIG. 1.

Directing devices 4 and 5, for example of the roller type, as shown in FIGS. 1 and 2, are capable of positioning, aligning and keeping at a prefixed close distance the two portions 21 and 22 of the rod upstream and downstream of the rotor 6.

The machine also comprises two idle snub pulleys 9 and 11 capable of inverting the direction of movement of the rod 2 from the first direction of movement to the second direction of movement, substantially opposite and, simultaneously, of directing said second portion 22 to the side of the first portion 21. At the same time, said idle pulleys 9 and 11, take the second part of surface of the rod 2 to be cleaned towards the rotor 6 without causing any torsion of the rod itself.

The pulleys 9 and 11 having axes 91 and 111, are inclined one respect to the other by a prefixed angle $\alpha$ such that it allows displacing of the backward portion 22 practically to the same level of the forward portion 21 while keeping one side by side to the other. Typically, the inclination angle $\alpha$ between the median planes 90 and 110 of the pulleys is of from about 1° to about 6°, preferably from about 2° to about 4°(FIG. 5).

Figure 3:
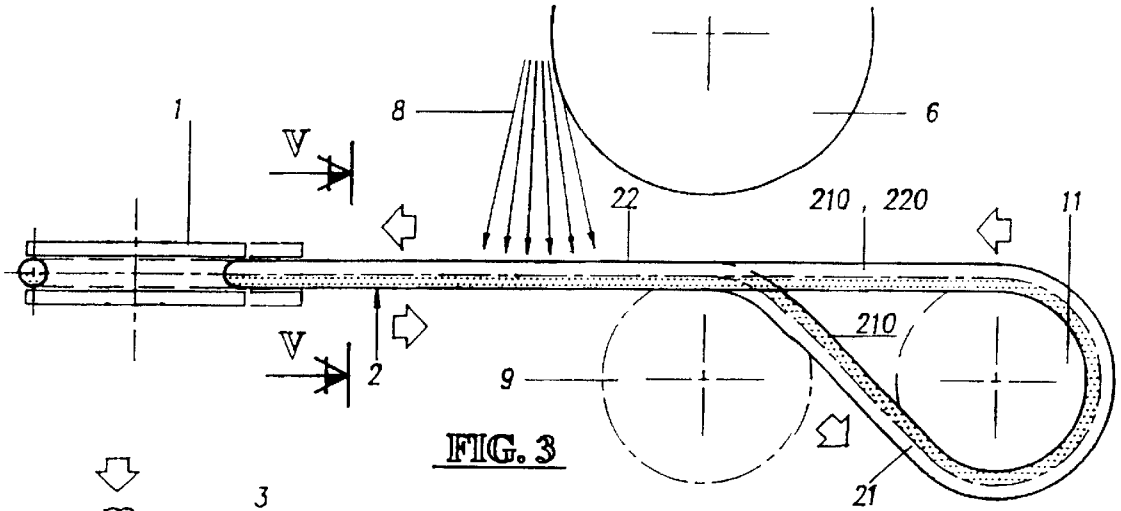
FIG. 3 is an enlarged front view of a rod and of snub pulleys of the shot-blasting machine of FIG. 1.

As is shown in FIG. 3, the snub pulley 9 supports the forward portion 21 of the rod and directs it downward so that it winds itself around the snub pulley 11 by an angle greater than 180°. In this way the snub pulley 11 brings the backward portion 22 of the rod back to one side of the forward portion 21 at least for the whole path travelled by the rod in the field of action of the jet of shots 8. In this way the two portions of the rod 21 and 22 are substantially parallel and lie practically on the same plane.

According to another embodiment, the forward portion 21 can wind itself around the pulley 11 through an angle greater than 180° and be directed upward so that the backward portion 22 is brought by the pulley 9 back to one side of the portion 21.

Figure 5:
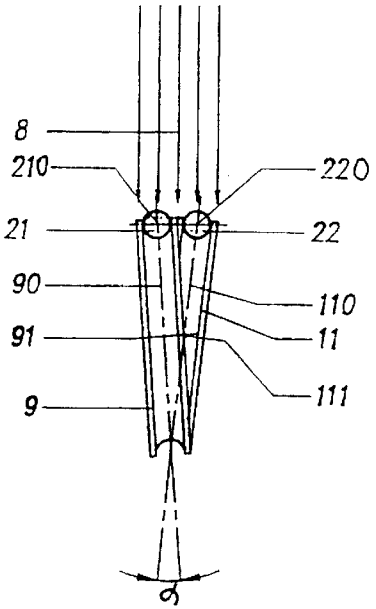
FIG. 5 is a cross-sectional view, taken along the line V—V of FIG. 3.
Figure 4:
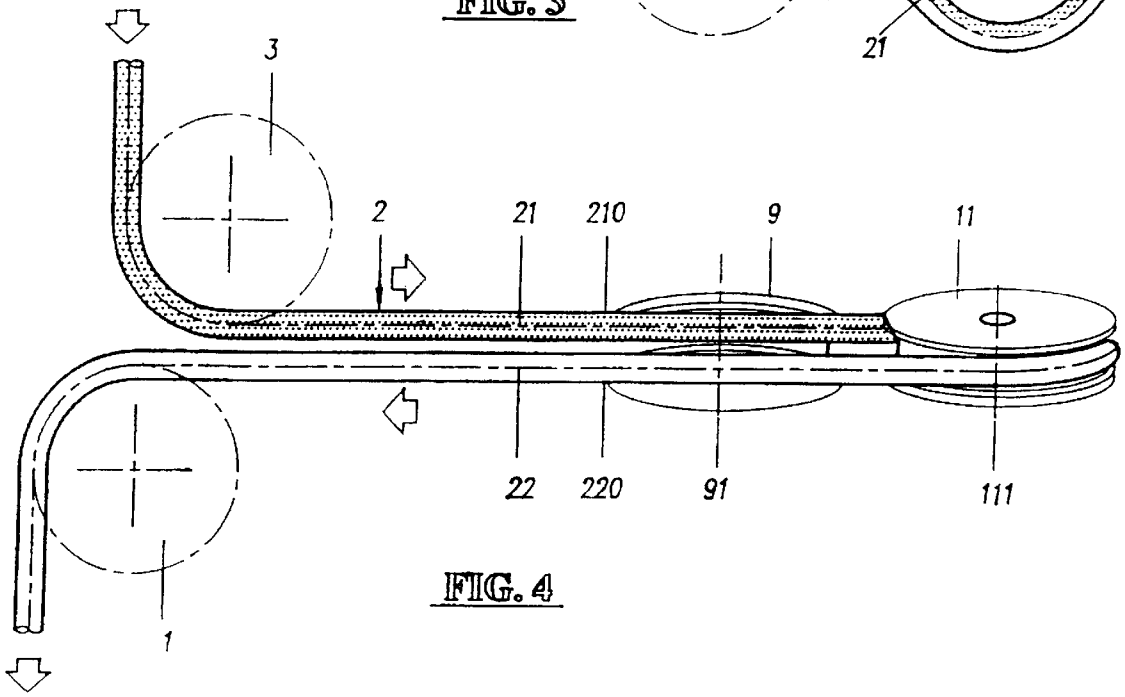
FIG. 4 is a plan view from above of the rod and of the snub pulleys of FIG. 3.

As is shown in FIGS. 3–5, the pulleys 9 and 11 cause the forward portion 21 of the rod to turn a part 210 of its external surface towards the rotor 6; while the backward portion 22 of the rod turns an opposite part 220 of its external surface towards the rotor 6. In this way the whole external surface of the rod is placed under the jet of shots 8 coming from the rotor 6 and it is so possible to clean the entire surface of the rod with a shot-blasting machine provided with just one rotor.

Figure 8:
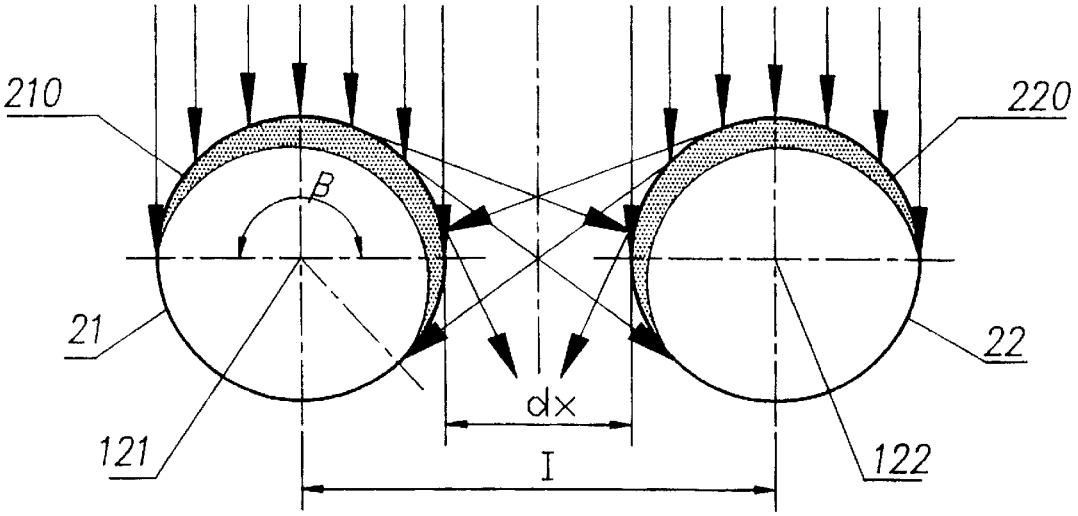
FIG. 8 shows in enlarged cross-section portions of metallic rod and a jet of shots of the machine of FIG. 1.

The distance dv (FIG. 8) between the two parts of external surface 210 and 220 of the portions 21 and 22 is at most equal to about 3 times the diameter of the rod 2, i.e. the distance between centers I of the rod portions 21 and 22 is, in this case, at most equal to 4 times the diameter of the rod 2. Preferably, the distance dv between the two parts of the surface 210 and 220 is of from about 0.1 to about 2 times the diameter of the rod 2 and, more preferably, is of from about 0.5 to about 1.5 times the diameter of the rod 2.

A suitable choice of the distance between the two parts of the surface 210 and 220 allows to increase the shot-blasting angle $\beta$ (FIG. 8), i.e. the central angle subtended to the arc of circumference that is hit by the jet of shots. In fact, it has been observed that, when the rod portions are sufficiently close, parts of the external surface 210 and 220 corresponding to an angle >180° are hit by the shots and cleaned. For example, with a rod having diameter of 6 mm and parallel portions having distance between centers I of 9.5 mm, the shot-blasting angle $\beta$ takes a value of about 235° (FIG. 8) versus a value of about 180° that is observed for a single rod portion. The reason for said increase of the shot-blasting angle has not yet thoroughly investigated. However, it seems that it could be due to shots rebounds from the surface of a rod portion to the close surface of the other rod portion. Of course, the present invention must not be considered to be limited in any way by such a speculation.

In order to avoid the dispersion of the jet of shots 8, the two portions 21 and 22 of rod 2 pass through the shot-blasting machine at a short distance from the rotor 6. Such distance has a value of from about 20 mm to about 200 mm. Preferably such value is of from about 40 mm to about 100 mm. The closeness of the rod 2 to the rotor 6 implies further advantages such as higher speed of the metal shots and greater concentration of the jet 8 on the surface to be cleaned.

As can be noted in FIG. 5, under the jet of shots 8 there are simultaneously present the part of surface 210 of the portion 21 and the opposite part 220 of the portion 22. In this way the efficiency of the shot-blasting machine is doubled with respect to that of a conventional shot-blasting machine where the rod passes under the shots jets only one time.

The pulleys 9 and 11 have the respective median planes 90 and 110 substantially orthogonal to the median planes of the pulleys 1 and 3 that, in the embodiment shown in the figures, are substantially horizontal. The arrangement of the pulleys 1, 3, 9 and 11 is such that all the deviations of direction of the rod 2 inside the machine take place without causing torsion of the rod itself.

The diameter of the snub pulleys 1, 3, 9 and 11 is selected in relation to the diameter and to the type of material of the rod 2. In particular, the ratio between the diameter of the pulleys and that of the rod is of from about 30 to about 100. Preferably it is of from about 50 to about 100.

The shot-blasting machine is arranged transversally to the direction of advancement 18 of the rod 2, meaning that the two directions of movement of the rod 2 inside the machine are substantially orthogonal to the direction of advancement 18, that represents the input and output direction of the rod 2 from the machine. In this way a reduction is thus obtained in the space occupied by the shot-blasting machine along the direction of advancement 18, along which other machines may be placed such as, for example, drawing machines, coiling machines and the like.

The rotor 6 rotates around an axis, lying in a plane perpendicular to the direction of movement of the two portions 21 and 22 and I to the plane containing the two portions.

Figure 6:
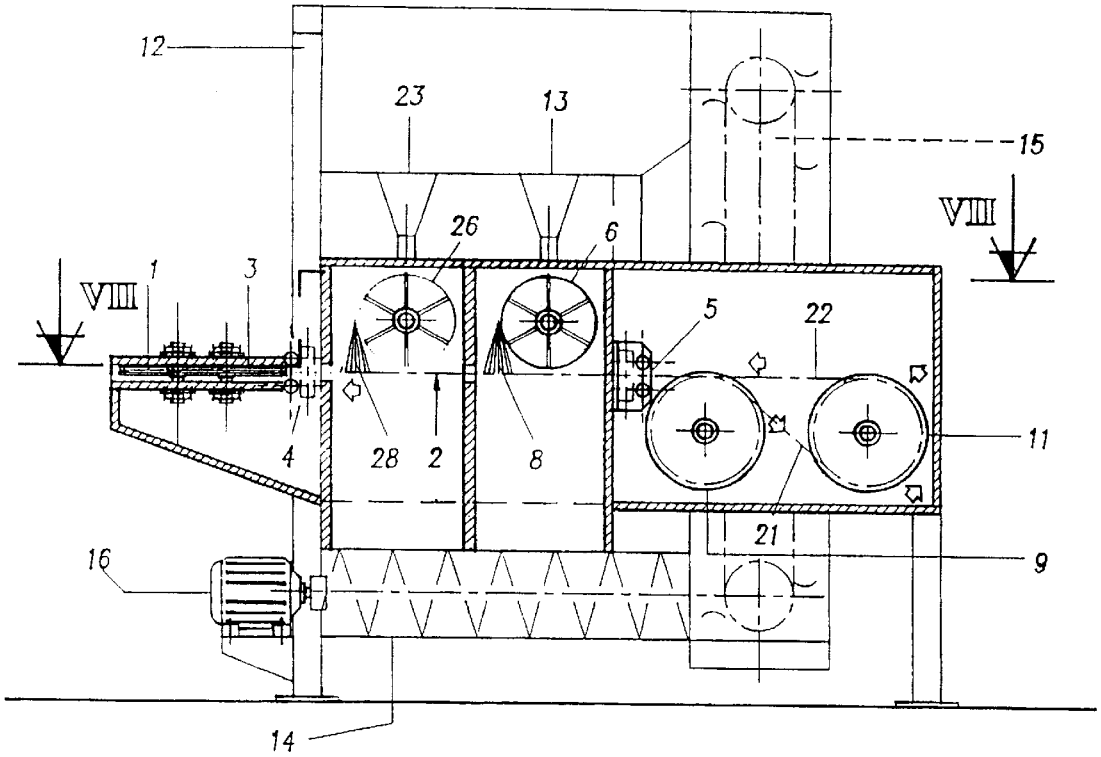
FIG. 6 is a partial, longitudinal cross-sectional view of a variant of the shot-blasting machine of FIG. 1.
Figure 7:
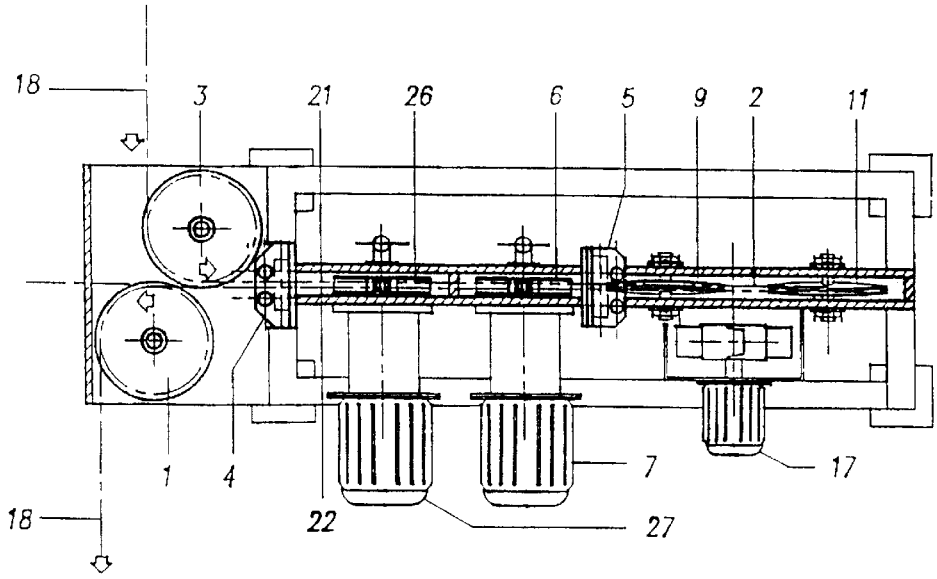
FIG. 7 is a partially sectioned view taken along the line VII—VII of FIG. 6.

Possibly, in the shot-blasting machine of the invention, in addition to the rotor 6, other rotors may be present. There is represented in FIGS. 6–7 a shot-blasting machine, made according to the invention, containing a second rotor 26 driven by an electric motor 27 and a further funnel 23, for feeding the shots, connected to an elbow pipe (not shown).

The rotor 26 is positioned, with respect to the rotor 6, above the plane containing the two portions 21 and 22, but it can be positioned even below such plane. In fact, in the shot-blasting machine made according to the invention, thanks to the double passage of the rod in the field of action of the jet 8 or of the jets of shots 8 and 28, the cleaning of the entire surface of the rod is obtained independently of the number of rotors present and of their positioning in the machine.

The machine comprising two rotors (FIGS. 6 and 7) of the same capacity and in the same operating conditions, allows to double the speed of advancement of the rod and thus to increase the productivity of the machine with respect to that with only one rotor. Alternatively, under the same forward speed of the rod and of operating conditions, it is possible to halve the power absorbed by the rotors.

Figure 9:
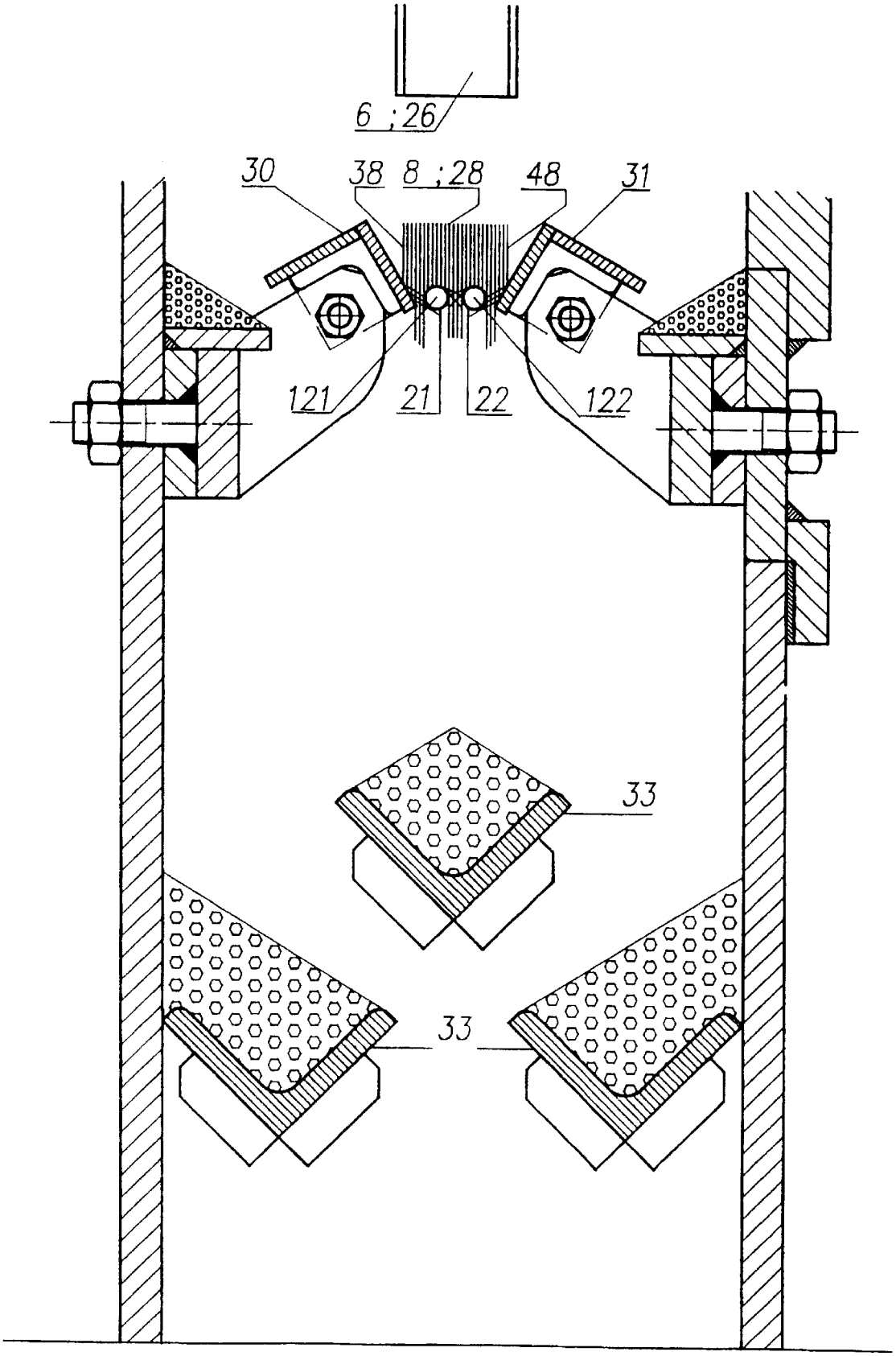
FIG. 9 shows another variant of the shot-blasting machine of FIG. 1.
Figure 10:
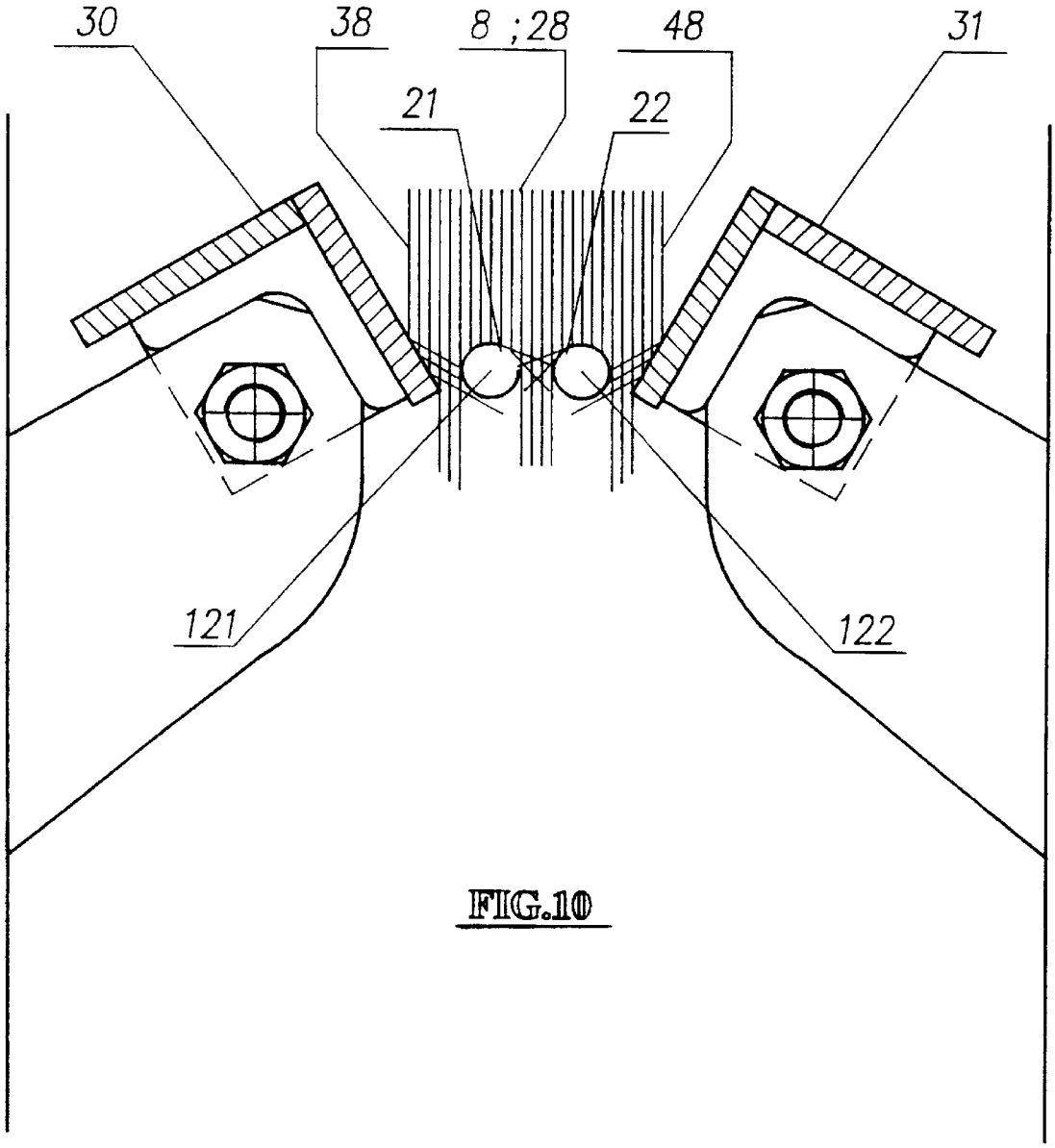
FIG. 10 shows enlarged portions of metallic rod, a jet of shots and baffles of the machine of FIG. 9.

FIGS. 9 and 10 show a variant of the shot-blasting machine of FIGS. 1–7, wherein baffles 30 and 31 are placed at the sides of the rod portions 21 and 22. The baffles 30 and 31 are inclined of a preselected angle with respect to the plane wherein the axes 121 and 122 of the rod portions 21 and 22 lie. Preferably said preselected angle is of from about 115° and about 120°. The baffles 30 and 31 have the task of deviating side fringes 38 and 48 of the jet of shots by directing them towards the sides of the rod portions 21 and 22. Thus, parts of external surface 210 and 220 corresponding to an angle β of about 270° are hit by the shots and cleaned. In this way, the shot-blasting angle is further increased and the side fringes of the jet of shots are utilized. Otherwise, said side fringes could not be able to hit the rod and should be practically ineffective for cleaning the rod. This helps in further improving the cleaning efficiency of the machine.

The shots used for cleaning the rod 2 is collected by shields 33 and, after having been reconditioned, is recycled towards the rotor. The shields 33 have the purpose of preventing the jet of shots from wearing bottom parts of the machine.

Figure 12:
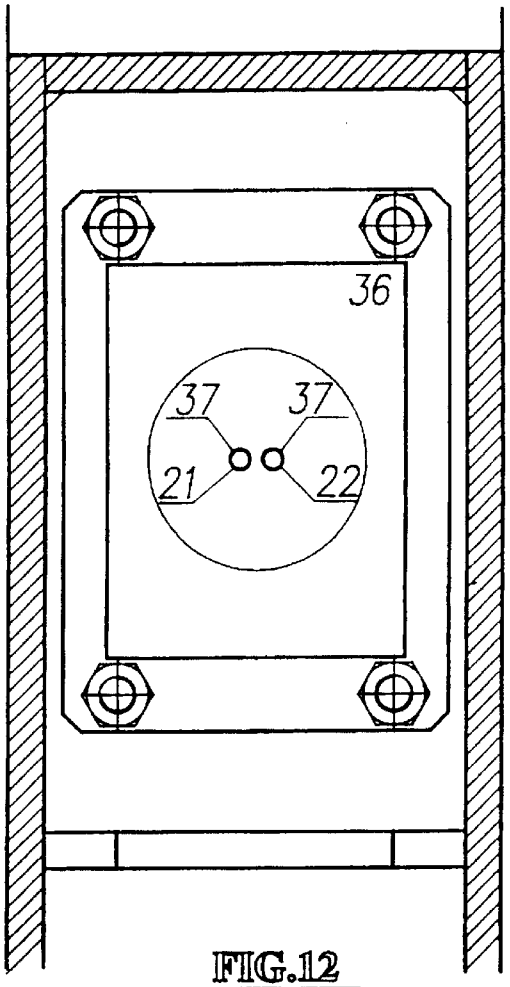
FIG. 12 is a cross-sectional view, taken along the line XII—XII of FIG. 11.
Figure 11:
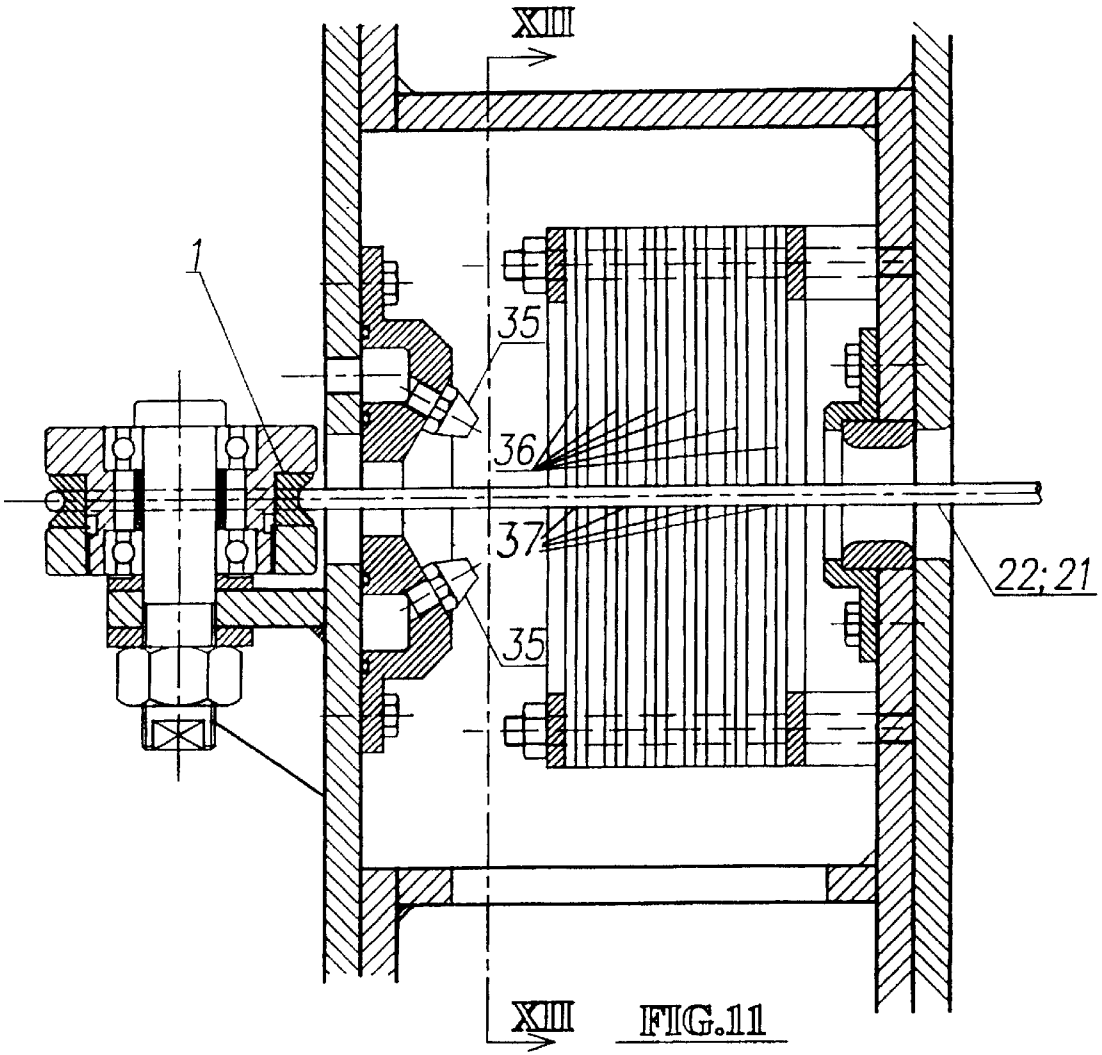
FIG. 11 shows a further variant of the shot-blasting machine of FIG. 1.

FIGS. 11 and 12 show another embodiment of the shot-blasting machine wherein between the snub pulleys 1 and 3 and the rotor 6 or 26 there are interposed a ring of nozzles 35 and a series of rubber curtains 36 which are provided with a pair of holes 37. The nozzles 35 blow air under pressure against the external surface of the rod portions 21 and 22, while the holes 37 of the curtains 36 have a wiping action on the external surface of the portions 21 and 22. The joint action of the air nozzles and curtains holes attain the complete removal of the possible shots that is carried out by the running rod.

In order to evaluate the cleaning efficiency level of the machine of the invention, shot-blasting tests have been carried out on wire samples by means of two equipment simulating the shot-blasting effects.

The efficiency has been measured as lost of weight of the wire samples caused by the shot-blasting.

Moreover, the shot-blasting angle β has been estimated under a microscope.

Figure 13:
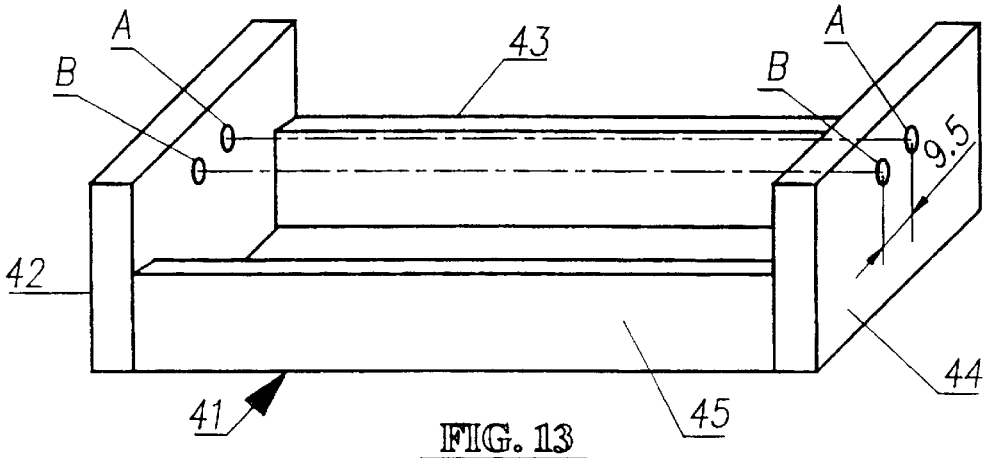
FIGS. 13 and 14 show frames of equipment simulating the shot-blasting machine according to the invention and that of FR-A-2 386 390.

A first equipment was made of a first frame (bracket) 41 (FIG. 13) formed by four vertical walls 42, 43, 44 and 45 wherein two opposite walls 42 and 44 were provided with two pairs of opposite and coaxial holes A—A and B—B capable of supporting the wire samples to be tested. The axes of the two pairs of opposite holes lay on a horizontal plane and were suitably spaced. The distance between centers I of the first and second pair of holes (A—A, B—B) was of about 9.5 mm.

Figure 14:
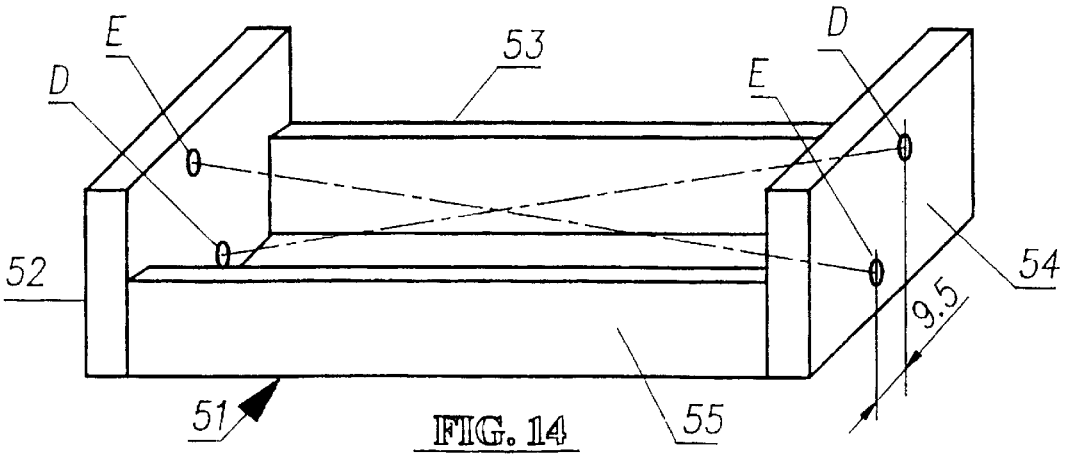

A second equipment was made of a second frame 51 (FIG. 14) formed by four vertical walls 52, 53, 54 and 55 wherein two opposite walls 52 and 54 were provided with two pairs of opposite and coaxial holes D–D and E–E capable of supporting the wire samples. The axes of the two pairs of opposite holes were reciprocally inclined of 30° and the distance between them was of about 9.5 mm.

Tests have been carried out under six different conditions and each test was repeated six times.

Figure 15:
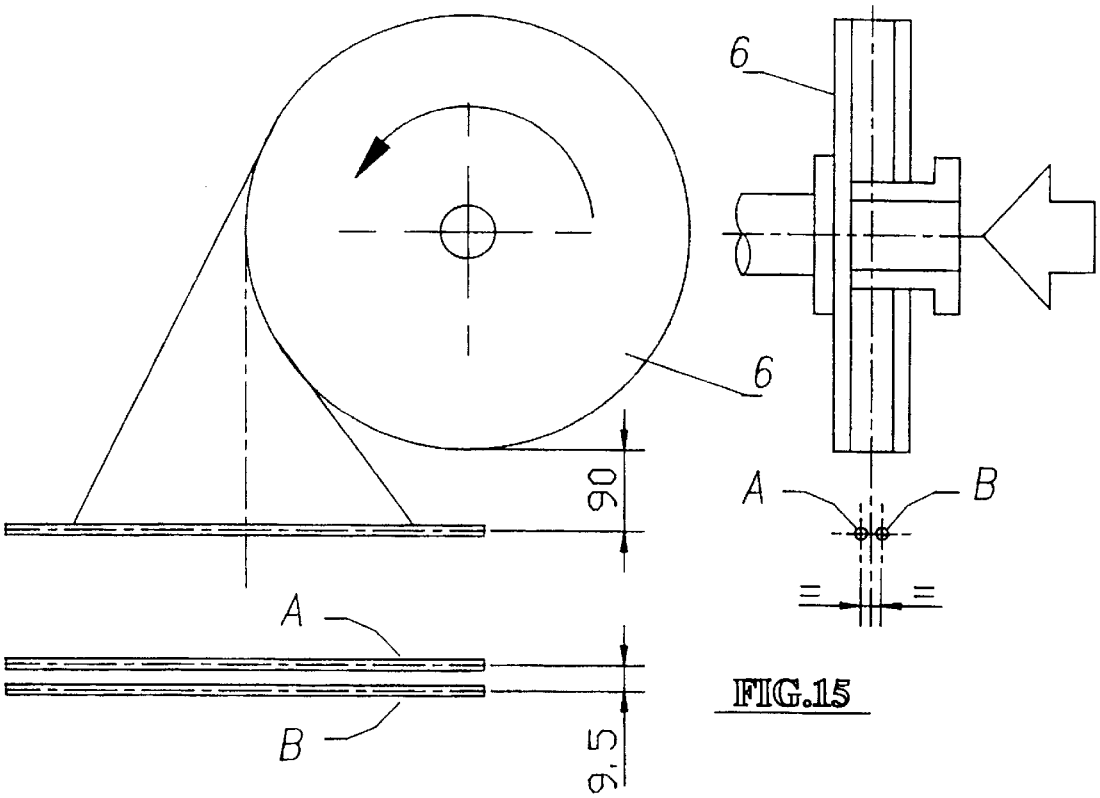
FIGS. 15 and 16 show some test conditions of the utilized simulating equipment.

The first test was carried out by placing in the first frame 41 a pair of parallel wire samples and by fastening them in A and B positions at a distance between centers I of about 9.5 mm (FIG. 15).

The second and third comparative tests were carried out by placing in the first frame 41 only one wire sample, placed in A position and B position, respectively.

Figure 16:
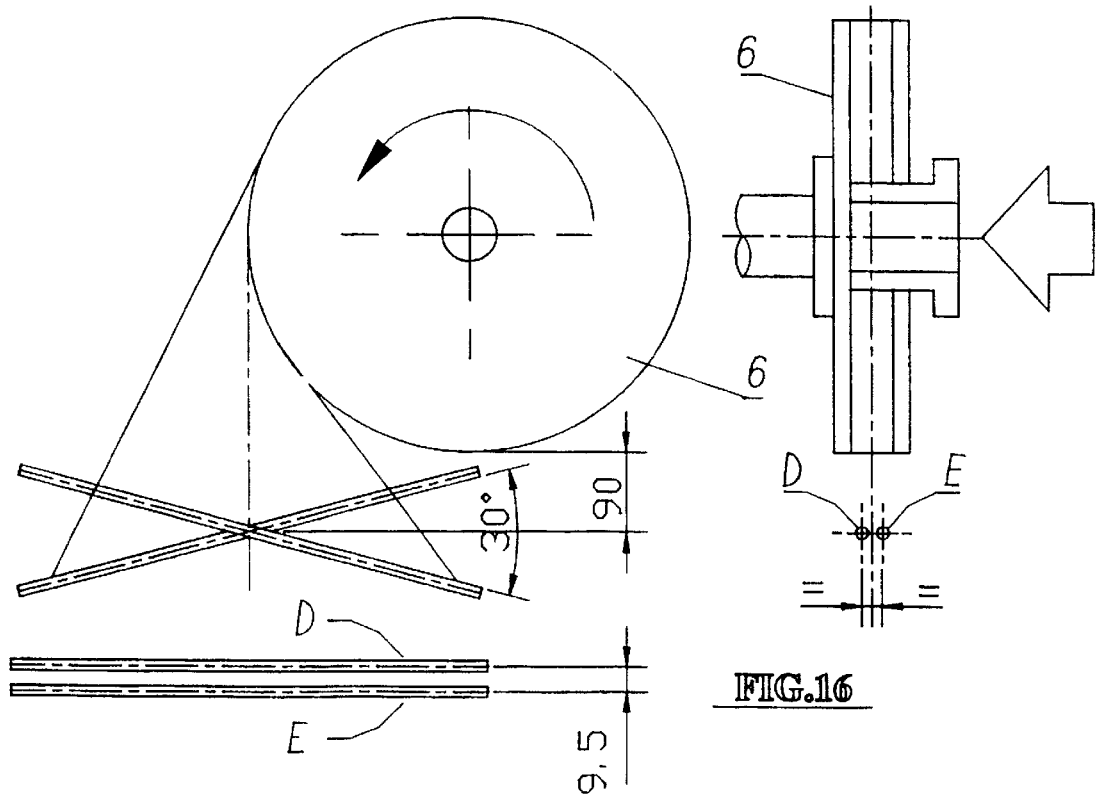

The fourth comparative test was carried out by placing in the second frame 51 a pair of wire samples and by fastening them in D and E positions, i.e. inclined of 30° one respect to the other and with the axes spaced of about 9.5 mm (FIG. 16).

The fifth and sixth comparative tests were carried out by placing in the second frame 51 only one wire sample, placed in D position and E position, respectively.

The operating conditions have been kept constant during the six series of tests and are reported in the following Table I.

TABLE I

| | |
|---|---|
| Distance of the wire samples from the rotor* | 90 mm |
| Shot-blasting time** | 30 sec |
| Width of the rotor vanes | 25 mm |
| Shots type | SAE S 110 (high carbon steel) |
| Electric current absorbed by the rotor engine corresponding to 10 Hp | 18.7 A |
| Shots flow rate | 150 kg/min |
| Material of the wire samples | DIN 17210 (C = 0.1%) |
| Diameter of the wire samples | 6 mm |
| Length of the wire samples | 490 mm |

*In the case of inclined wire samples said distance has been measured departing from the intersection point of the two wire samples (FIG. 16).
**The start and the stop of the shots delivery have been electronically controlled by means of a timer.

Before the shot-blasting operation, all the wire samples have been completely degreased and weighed with an analytical balance sensitive up to a decimilligram.

During the tests with pairs of wire samples, the frames have been positioned in such a way that the middle plane of the rotor vanes was equidistant from A—A and B—B or D—D and E—E, respectively.

After the shot-blasting step, the wire samples have been weighed again.

The test results are reported in the following Table II.

TABLE II

| Test No. | Wire samples arrangement | Average weight reduction (%) of each wire sample | Average weight reduction (%) of pairs of wire samples |
|---|---|---|---|
| 01 | Two parallel wire samples (I = 9.5 mm) | (A) = 0.405<br>(B) = 0.245 | 0.325 |
| 02 | Single (A) | 0.367 | (A + B) = 0.284 |
| 03 | Single (B) | 0.200 | |
| 04 | Two inclined wire samples (Distance = 9.5 mm) | (D) = 0.301<br>(E) = 0.257 | 0.279 |
| 05 | Inclined (D) | 0.333 | (D + E) = 0.257 |
| 06 | Inclined (E) | 0.180 | |

The results of the tests show that the weight reduction of the first wire samples (A and D) was greater than that of the second ones (B and E). Apparently, the shots flow was not uniformly distributed along the whole rotor vanes width and thus the shots amount directed to the positions A and D was greater than that directed to the positions B and E. In order to compensate said difference, it has been calculated the average weigh reduction of the first and second wire samples as shown in the last column of Table II.

The average experimental results of test 01 shown in the last column of Table II simulate the working of a shot-blasting machine according to the present invention, while those of tests 02 to 06 simulate the working of known shot-blasting machines.

The average weight reduction of the wire samples which have been treated according to the present invention is significantly greater than that of the wire samples treated according to the prior art. In addition, the wire samples treated according to the prior art show average weight reductions substantially equivalent one to the other.

As far as the shot-blasting angle β is concerned, under the microscope it has been measured a value of about 235° for the samples of test 01, while the value was of about 180° for the samples of tests 02, 03, 05 and 06, and of about 200° for the samples of test 04.

What is claimed is:

1. A shot-blasting machine for cleaning a surface of a metal rod, said machine comprising a) guiding means for said metal rod, and b) at least a rotor provided with vanes, said rotor being capable of projecting a jet of shots against said metal rod, c) said guiding means being capable of directing said metal rod in a field of action of said jet of shots at least a first and a second time, exposing in said field of action simultaneously at least a first and a second part, respectively, of said surface, a first portion of said metal rod turning said first part of said surface towards said jet of shots and a second portion of said metal rod turning said second part of said surface towards said jet of shots, characterized in that d) said guiding means comprise a first, a second, a third and a fourth snub pulley, said third and said fourth snub pulley being inclined one respect to the other by a prefixed angle (α), e) said third snub pulley supports said first portion of said metal rod and directs said metal rod downward, or upward, while said fourth snub pulley causes said metal rod to wind around said fourth snub pulley by an angle greater than 180°, so that said fourth snub pulley, or said third snub pulley, brings said second portion of said metal rod back to the side of said first portion, f) said at least a first and a second part of the surface are kept under said jet of shots practically on a same plane, side by side and at a prefixed close distance at least for the whole path travelled by said metal rod in said field of action of said rod under said jet of shots, and g) said second part of said external surface being opposite to said first part for placing the whole external surface of said rod under said jet of shots.

2. A shot-blasting machine according to claim 1, characterized in that said guiding means also comprise directing devices capable of positioning, aligning and keeping at said distance (dv) said first and second portion of said metal rod upstream and downstream of said rotor, where said metal rod has a prefixed diameter and said distance (dv) is equal or lower than about 3 times the diameter of said metal rod.

3. A shot-blasting machine according to claim 2, characterized in that said distance (dv) is of from about 0.1 to about 2 times the diameter of said metal rod.

4. A shot-blasting machine according to claim 2, characterized in that said distance (dv) is of from about 0.5 to about 1.5 times the diameter of said metal rod.

5. A shot-blasting machine according to claim 1, characterized in that said third and fourth snub pulley are inclined one respect to the other by a prefixed angle (α) of from about 2° to about 4°.

6. A shot-blasting machine according to claim 1, characterized in that said third and fourth snub pulley are capable of directing said first portion of said metal rod in a first direction of movement and said second portion of said metal rod in a second direction of movement substantially opposite with respect to said jet of shots.

7. A shot-blasting machine according to claim 1 to characterized in that said first snub pulley is capable of directing said first portion of said metal rod, coming from one direction of advancement, towards said first direction of movement and said second snub pulley is capable of directing said second portion of said metal rod, coming from said second direction of movement, towards said direction of advancement.

8. A shot-blasting machine according to claim 1, characterized in that said third and fourth snub pulley are inclined one respect to the other by a prefixed angle (α) of from about 1° to about 6°.

9. A shot-blasting machine according to claim 1, characterized in that said directions of movement of said portions of said metal rod inside the machine are substantially orthogonal to said direction of advancement.

10. A shot-blasting machine according to claim 1, characterized in that it comprises two rotors.

11. A shot-blasting machine according to claim 10, characterized in that said rotors are on the same side with respect to said first and second portion of said metal rod.

12. A shot-blasting machine according to claim 10, characterized in that said rotors are on opposite sides with respect to said first and second portion of said metal rod.

13. A shot-blasting machine according to claim 1, characterized in that said at least one rotor rotates around an axis substantially perpendicular to said first and second portion of said metal rod.

14. A shot-blasting machine according to claim 1, characterized in that said portions of said metal rod have a distance from said at least one rotor of a value of from about 20 mm to about 200 mm.

15. A shot-blasting machine according to claim 1, characterized in that said portions of said metal rod have a distance from said at least one rotor of a value of from about 40 mm to about 100 mm.

* * * * *